US007036960B1

(12) United States Patent
Gretz

(10) Patent No.: US 7,036,960 B1
(45) Date of Patent: May 2, 2006

(54) LIGHT LOUVER POST

(75) Inventor: Thomas J. Gretz, Clarks Summit, PA (US)

(73) Assignee: Arlington Industries, Inc., Scranton, PA (US)

( * ) Notice: Subject to any disclaimer, the term of this patent is extended or adjusted under 35 U.S.C. 154(b) by 136 days.

(21) Appl. No.: 10/713,994

(22) Filed: Nov. 14, 2003

Related U.S. Application Data

(63) Continuation-in-part of application No. 10/328,318, filed on Dec. 23, 2002, now Pat. No. 6,779,764, which is a continuation-in-part of application No. 10/253,185, filed on Sep. 24, 2002, now Pat. No. 6,585,221, which is a continuation-in-part of application No. 10/112,563, filed on Mar. 28, 2002, now Pat. No. 6,752,362, which is a continuation-in-part of application No. 09/860,064, filed on May 17, 2001, now abandoned.

(51) Int. Cl.
*F21V 11/02* (2006.01)

(52) U.S. Cl. ..... 362/354; 362/279; 362/153; 362/329; 362/276; 362/431

(58) Field of Classification Search ..... 362/279, 362/153, 153.1, 329, 276, 431
See application file for complete search history.

(56) References Cited

U.S. PATENT DOCUMENTS

| | | | | | |
|---|---|---|---|---|---|
| 2,869,690 | A | * | 1/1959 | Winters et al. | 362/431 |
| 3,593,014 | A | * | 7/1971 | Vesely | 362/291 |
| 3,697,740 | A | * | 10/1972 | Breed et al. | 362/257 |
| 3,833,804 | A | * | 9/1974 | Vesely | 362/291 |
| 4,513,358 | A | * | 4/1985 | Lemme | 362/276 |
| 4,814,961 | A | | 3/1989 | O'Brien et al. | |
| 4,996,636 | A | | 2/1991 | Lovett | |
| 5,068,773 | A | * | 11/1991 | Toth | 362/386 |
| 5,297,013 | A | | 3/1994 | Hall et al. | |
| 5,367,442 | A | | 11/1994 | Frost et al. | |
| 5,628,558 | A | * | 5/1997 | Iacono et al. | 362/288 |
| 6,017,131 | A | * | 1/2000 | Goins | 362/249 |
| 6,309,091 | B1 | * | 10/2001 | Weissman | 362/354 |
| 6,494,599 | B1 | * | 12/2002 | Leen | 362/362 |

* cited by examiner

*Primary Examiner*—Sandra O'Shea
*Assistant Examiner*—Anabel Ton

(57) ABSTRACT

A light fixture for mounting a light and one or more electrical devices to either the ground or a structural surface. The light fixture includes an integral rectangular base assembly with a plurality of vertical framing members. A light transmitting tube is slidingly carried over the vertical framing members and a plurality of louver members are slidingly carried over the light transmitting tube. The light fixture provides a weatherproof enclosure for enclosing the light, the electrical devices, and all associated electrical wiring.

6 Claims, 5 Drawing Sheets

LIGHT LOUVER POST

This application is a Continuation-In-Part of U.S. patent application Ser. No. 10/328,318 entitled "Garden Post with Elongated Electrical Box", filed Dec. 23, 2002, now U.S. Pat. No. 6,779,764, which is a Continuation-In-Part of U.S. patent application Ser. No. 10/253,185 entitled "Garden Post", filed Sep. 24, 2002 and now U.S. Pat. No. 6,585,221, which is a Continuation-In-Part of U.S. patent application Ser. No. 10/112,563 entitled "Outdoor Garden Post", filed Mar. 28, 2002, now U.S. Pat. No. 6,752,362, which is a Continuation-In-Part of U.S. patent application Ser. No. 09/860,064 entitled "Landscape Fixture Support Post", filed May 17, 2001, now abandoned. All of the above stated references are incorporated herein by reference and should be considered a part of this application as if the information contained therein were set forth herein.

FIELD OF THE INVENTION

The present invention relates to the field of outdoor light fixtures and electrical devices, and more particularly to a light fixture that enables easy installation of lights and electrical devices in an outdoors setting.

BACKGROUND OF THE INVENTION

It is common for homeowners to install lighting fixtures on their property. Outdoor lighting systems are well known and most oftentimes take the form of a stake connected to a light fixture. The stake is buried in the ground and wiring is run from an electrical supply to the light fixture. Most commonly, the electrical supply is a low voltage transformer connected to house current.

In addition to light fixtures, it is also common for homeowners to install electrical devices in outdoor locations, which are most commonly duplex receptacles but can also be other electrical devices such as switches, or photocells.

Although the prior art includes many devices for supporting outdoor lighting fixtures and various other devices for supporting outdoor electrical devices, there are few compact devices available for installing both an outdoor lighting fixture and an outdoor electrical device in a common enclosure that can be mounted either in the ground or to a structural surface.

U.S. Pat. No. 4,814,961 to O'Brien et al. for example, discloses a light fixture including a bulb and lens assembly that can be mounted on a hollow post supported by a ground stake. The bulb and lens assembly includes a lens that carries a plurality of louvers. The louvers include legs and slots so that the distance between the louvers can be adjusted to vary the appearance of the light fixture and the amount of light emitted light.

U.S. Pat. No. 5,367,442 to Frost et al. discloses a solar powered lamp configured to function more efficiently at elevated temperatures. The solar powered lamp can be equipped with decorative disks or louver-type members, which, in the event of rain or the like, advantageously prevent moisture from entering into the upper portion of the lamp.

U.S. Pat. No. 5,297,013 to Hall et al. discloses an outdoor light fixture that has a cover with a clear pane and an inner refracting lens adapted to refract light emitted from a light source and to fit over the light source. The light fixture may include a globe assembly and a louver installed thereon.

U.S. Pat. No. 4,996,636 to Lovett discloses a low voltage light fixture for use with a multi-conductor wire including a light bulb receptacle and a stake or post for supporting the fixture. The light fixture includes a head unit having a pagoda-style fixture head, which includes a base, a lens, a center tier, a top tier, a top cap, a lamp, and lamp/wire interconnect conductors.

Although all of the above patents disclose various light fixtures for providing light in an outdoor environment, they suffer from several disadvantages. They all include stakes, which limits them to being anchored in the ground. They cannot be easily mounted to structural outdoor surfaces, such as on a deck, patio, walkway, or a set of steps.

Although the cited prior art references disclose a means for providing a light fixture anchored to the ground, they do not provide for easy addition of electrical devices for providing other electrical services. Many times a homeowner desires an electrical receptacle for plugging in various devices that require house current, such as weed eaters, leaf blowers, and other lawn or garden equipment. It would be advantageous in times such as these to have access to readily available electrical current at the light fixture, instead of having to stretch electrical cord to the house itself.

Additionally, several of the above prior art light fixtures are designed for use with a specific light source. This neglects the fact that not all homeowners desire the same type of light source, and that it would be advantageous to allow the homeowner to supply whatever light source is most desirable for his needs. Some homeowners may, for example, desire a halogen light source for example, instead of a common incandescent light source.

Therefore, what is needed is an apparatus for enclosing both a light source and an electrical device. The apparatus should also be capable of mounting the light source and electrical device to either the ground or to a structural surface. Furthermore, the apparatus would be capable of accepting a wide variety of light sources.

OBJECTS OF THE INVENTION

An advantage of the light fixture of the present invention is that it may be easily mounted to either the ground or to a structural surface, such as a deck or patio.

The light fixture of the present invention also provides for the mounting of one or more electrical devices, such as a duplex receptacle, in addition to a light fixture.

The electrical devices mounted within the light fixture can be standard wall-mounted electrical devices, which is an advantage in that they are readily available at hardware stores and can be easily installed by a homeowner.

Another advantage is that the light fixture can accept most types of lighting fixtures, including high or low voltage lights and various types of high voltage bulbs, such as incandescent or halogen bulbs.

The light fixture also advantageously provides a weatherproof housing for enclosing and protecting wiring connections.

An additional advantage is that the light fixture provides a plurality of louvers for controlling the amount of light escaping therefrom, for directing the light in a downward direction, and for increasing the attractiveness of the post.

Additionally, the light fixture is stable, durable, easily maintained and accessed after installation, and can be easily and inexpensively manufactured.

These, and other objects, will become readily apparent to one of skill in the art having regard for this disclosure.

BRIEF DESCRIPTION OF THE INVENTION

The invention is a light fixture for mounting a light and an electrical device to either the ground or a structural surface. The light fixture includes an integral rectangular base assembly having a base, a plurality of vertical framing members extending from the top of the base defining four open windows, a resting seat at the top end of the base, and a horizontal connector member connecting the top end of the framing members. A light transmitting tube is slidingly carried over the vertical framing members and the horizontal connector member. One or more open louver members having central openings therein are slidingly carried over the light transmitting tube and supported by the resting seat. A closed louver member is carried over the light transmitting tube and substantially covers the light transmitting tube and the top end of the base assembly. Corner posts extend downward from each of the louver members and a fastening arrangement secures the light transmitting tube and the louver members to the base assembly. The open and closed louver members thereby form a vertically stacked layer of louver members surrounding the light transmitting tube with the corner posts maintaining open areas within the vertically stacked layer of louver members. Light from a light source installed within the light fixture will thereby be transmitted from the light source through the windows, the light transmitting tube, and the open areas in the vertically stacked layer of louver members.

REFERENCE NUMERALS USED IN THE SPECIFICATION AND DRAWINGS

Figure 1:
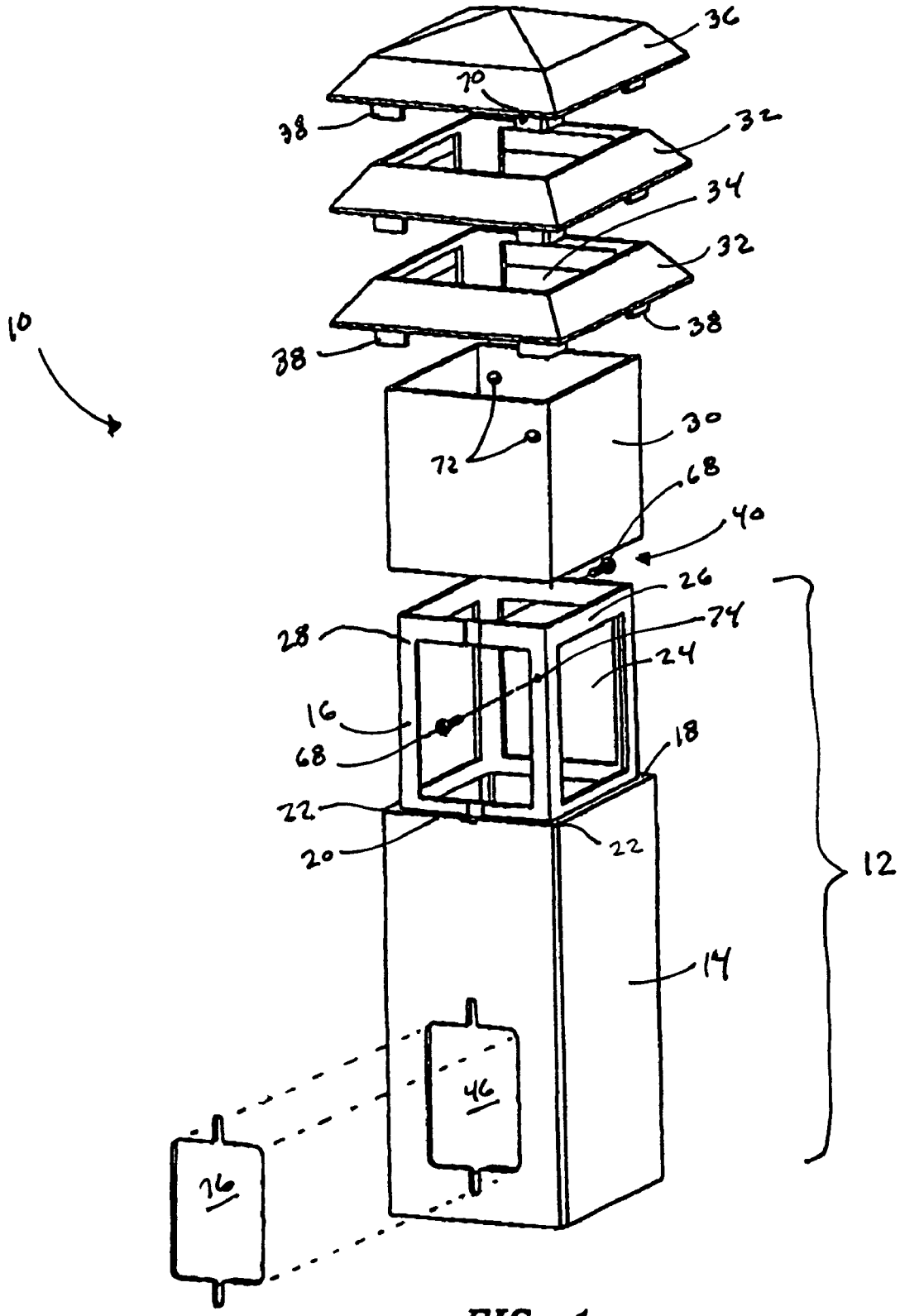
FIG. 1 is an exploded perspective view of a preferred embodiment of a light fixture according to the present invention.

10 - light fixture
11 - support
12 - integral rectangular base assembly
14 - base
16 - vertical framing member
18 - resting seat
20 - top end of base
22 - corner
24 - window
26 - horizontal connector member
28 - top end of vertical framing member
30 - light transmitting tube
32 - open louver member
34 - central opening
36 - closed louver member
38 - corner post
40 - fastening arrangement
42 - vertically stacked layer of louver members -continued 44 - open area
46 - access opening
48 - first water dam
50 - second water dam
52 - peripheral lip of closed louver member
54 - outer surface of vertical framing member
60 - peripheral lip on bottom of base
62 - inner seat on bottom of base
64 - inner wall of outer peripheral lip
68 - fastener
70 - aperture in closed louver member
72 - aperture in light transmitting tube
74 - aperture in vertical framing member
76 - blank cover

DETAILED DESCRIPTION

As this invention may be more easily explained by reference to the attached drawings, it should be noted that the figures are representative and exemplary of the invention only, and should not be construed as limiting the scope of the invention in any way.

Figure 2:
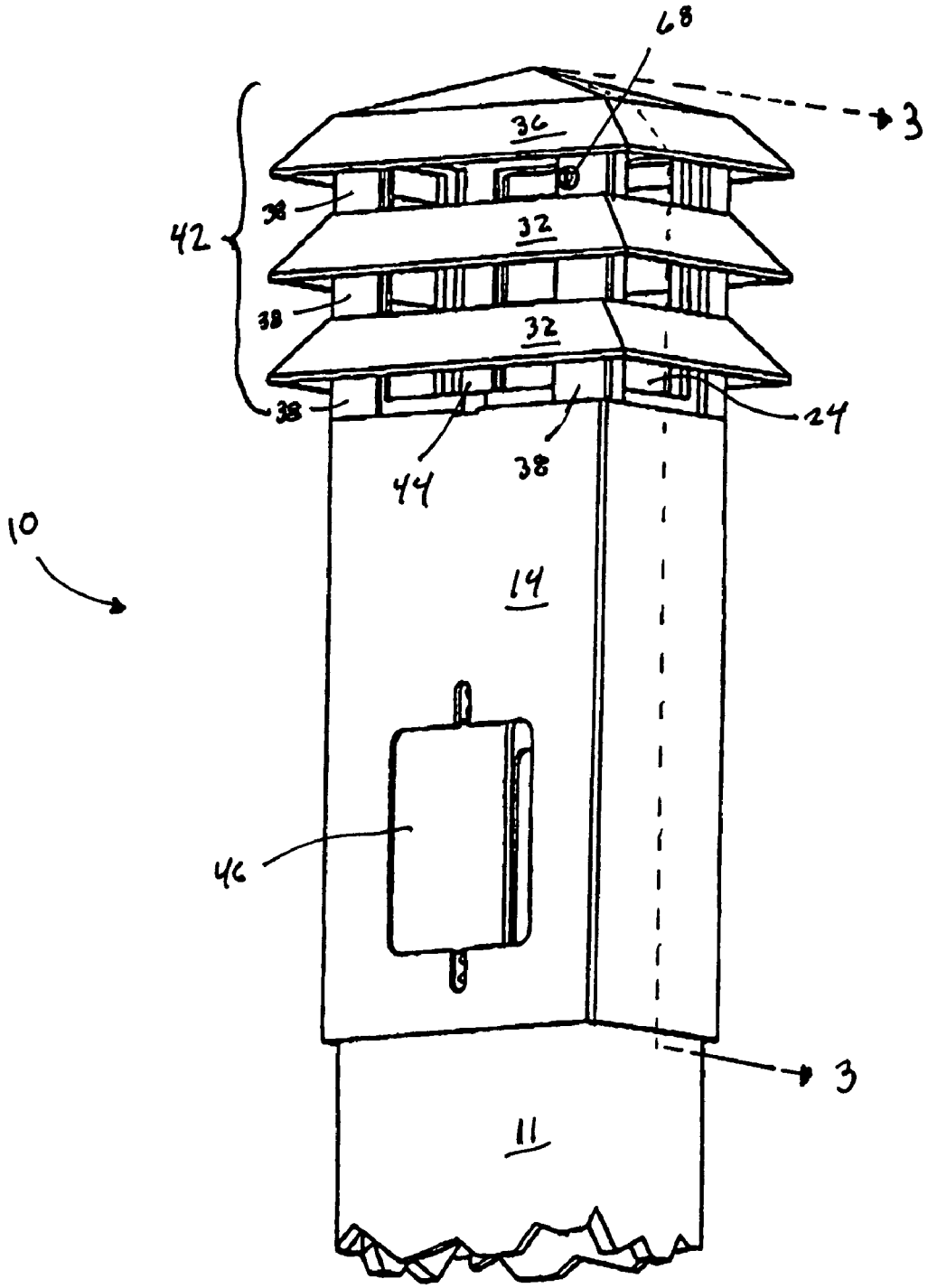
FIG. 2 is a perspective view of the light fixture of FIG. 1.

Referring to FIG. 2, the present invention is a light fixture 10 for installing a light and, if desired, an electrical device outdoors. The light fixture may be installed on a support 11, a portion of which is shown in FIG. 2 and which may take the form of a support for anchoring a light fixture in the ground, such as the base member disclosed in U.S. Pat. No. 6,585,221. The support may also take the form of a support for anchoring a light fixture to a structural surface, such as the base member disclosed in U.S. Serial patent application Ser. No. 10/252,781, filed Sep. 23, 2002, all of which is incorporated herein by reference. The light fixture of the present invention may therefore be mounted to a structural surface such as the surface of a deck or porch.

With reference to the exploded perspective view of FIG. 1, the light fixture 10 includes a an integral rectangular base assembly 12 having a base 14, a plurality of vertical framing members 16, and a resting seat 18 at the top end 20 of the base 14. The vertical framing members 16 extend from the four corners 22 of the top end 20 of the base 14 and define four open windows 24. A horizontal connector member 26 connects the top ends 28 of the vertical framing members 16.

A light transmitting tube 30 is slidingly carried over the vertical framing members 16 and the horizontal connector member 26. One or more open louver members 32 having central openings 34 therein are slidingly carried over the light transmitting tube 30 and are supported by the resting seat 18. A closed louver member 36 is slidingly carried over the light transmitting tube 30 on top of the open louver members 32. The closed louver member 36 substantially covers the light transmitting tube 30 and the base assembly 12. Corner posts 38 extend downwards from each of the open 32 and closed 36 louver members. A fastening arrangement 40 secures the light transmitting tube 30 and louver members 32, 36 to the base assembly 12.

After the louver members 32, 36 and light transmitting tube 30 are secured to the base assembly 12, as shown in FIG. 2, the open 32 and closed 36 louver members form a vertically stacked layer of louver members 42 surrounding the light transmitting tube 30 with the corner posts 38 maintaining open areas 44 within the vertically stacked layer of louver members 42 thereby allowing transmission of light from the light fixture 10 through the windows 24, the light transmitting tube 30, and the open areas 44 in the vertically stacked layer of louver members 42.

Referring to FIG. 2, one or more access openings 46 may be included in the base 14 of the light fixture 10. The base 14 has a rectangular cross section to allow the access openings 46 to accept any standard wall-mounted electrical device, such as a duplex receptacle (not shown).

Figure 3:
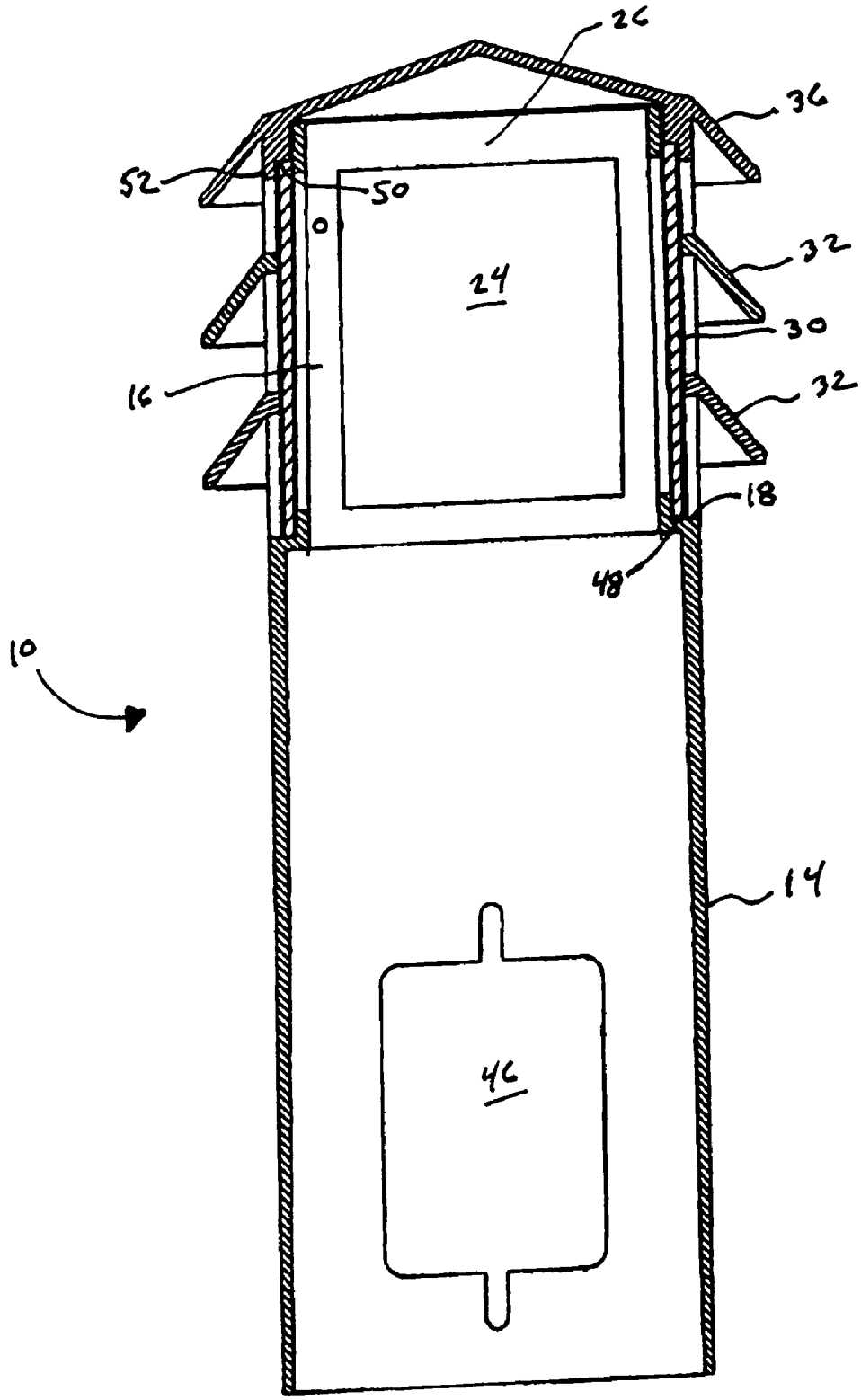
FIG. 3 is a sectional view of the light fixture taken along line 3—3 of FIG. 2.

The integral rectangular base assembly 12 is typically molded from plastic in one piece and includes a cross-sectional profile as shown in FIG. 3. To provide a weatherproof enclosure, the base 14 includes a first water dam 48 at the intersection of the vertical framing member 16 and the resting seat 18. When the light transmitting tube 30 is slidingly placed over the vertical framing member 16, a tight, weatherproof seal is created between the light transmitting tube 30 and the first water dam 48. The first water dam 48 seals against the bottom and inside surfaces of the light transmitting tube 30. To further waterproof the interior of the light fixture 10, a second water dam 50 is provided at the point where the closed louver member 36 contacts the light transmitting tube 30. A peripheral lip 52 extends from the lower surface of the closed louver member 36. A second water dam 50 is located at the intersection of the lower surface of the closed louver member 36 and the peripheral lip 52. The second water dam 50 creates a weatherproof seal between the top end of the light transmitting tube 30 and the closed louver member 36. The first 48 and second 50 water dams therefore seal the around the bottom and top of the light transmitting tube 30 and provide a waterproof enclosure within the light fixture 10.

Figure 4:
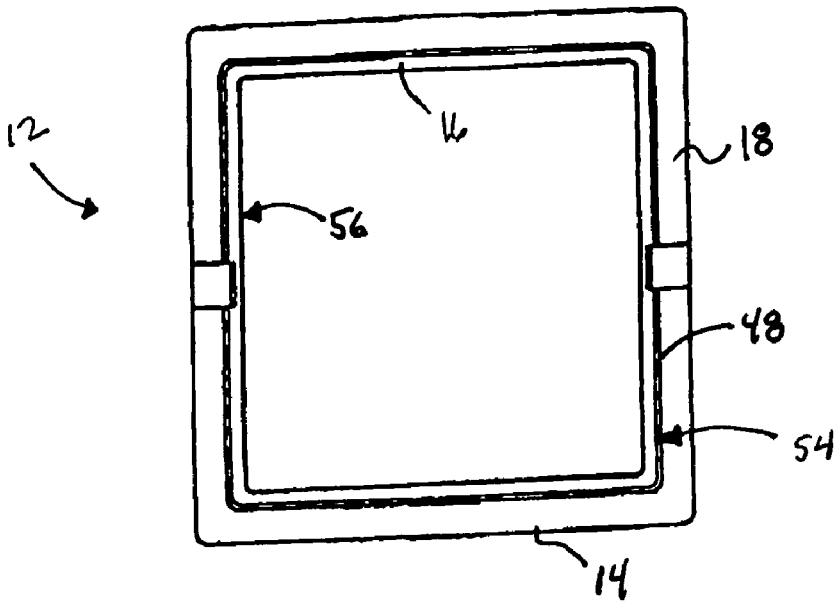
FIG. 4 is a top view of the base assembly taken along line 4—4 of FIG. 5.

Referring to FIG. 4, the top of the base assembly 12 includes the resting seat 18 and the first water dam 48. The resting seat 18 is a smooth flat surface that will be oriented horizontally after the base assembly 12 is secured to a support. A first water dam 48 is created at the juncture of the outer surface 54 of the vertical framing member 16 and the resting seat 18. The outer surface 54 of the vertical framing member 16 and the smooth flat surface of the resting seat 18 create the first water dam 48 when the light transmitting tube is slidingly fitted thereon.

Figure 6:
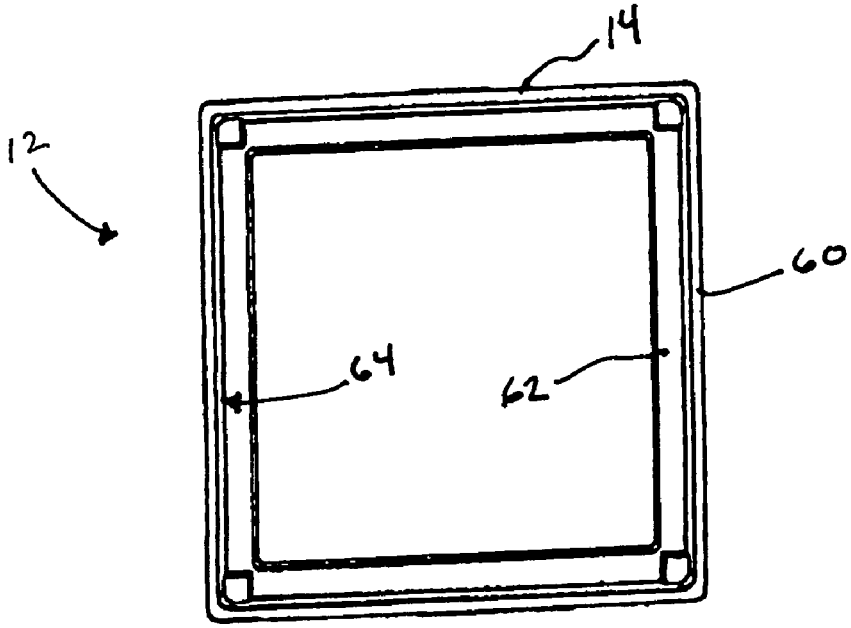
FIG. 6 is a bottom view of the base assembly taken along line 6—6 of FIG. 5.

With reference to FIG. 6, the bottom of the base 14 includes an outer peripheral lip 60 and an inner seat 62. A typical support used to anchor the base in the ground or to a structural surface would include side walls (not shown) dimensioned to fit snugly within the peripheral lip 60. An adhesive is typically used to secure the base 14 to an appropriate support with the adhesive applied to the surface of the inner wall 64 of the peripheral lip 60 and to the inner seat 62.

Figure 5:
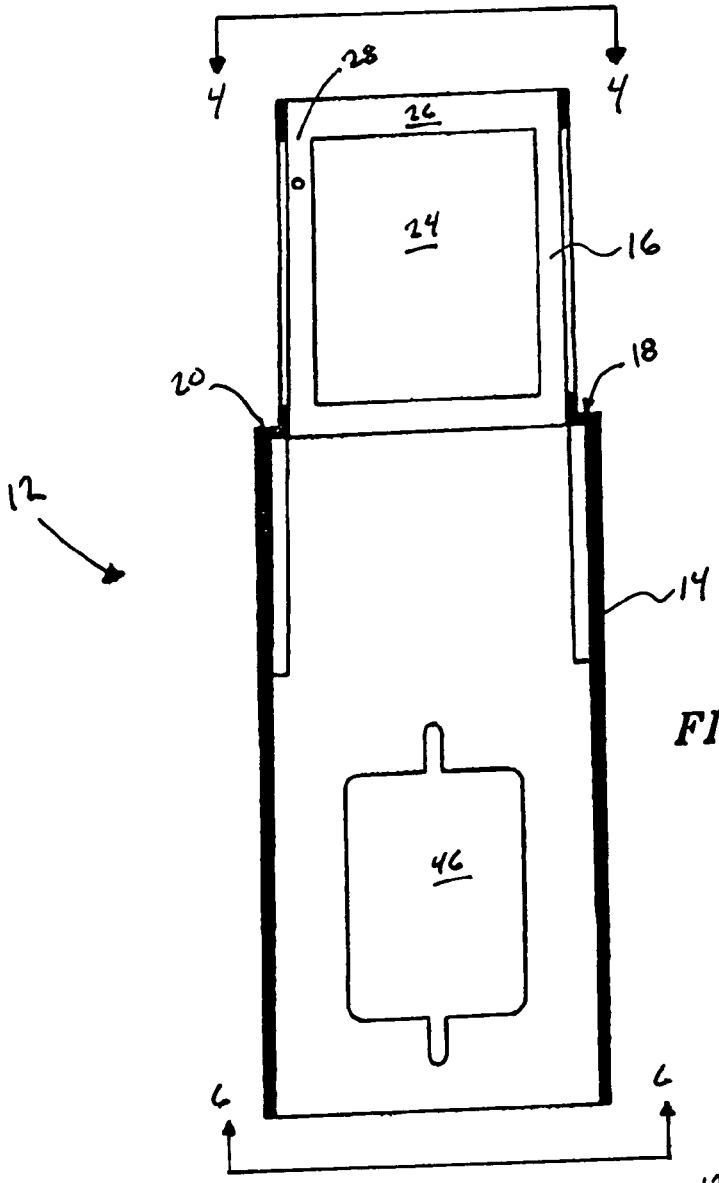
FIG. 5 is a sectional view of the base assembly portion of the present invention.

Referring to FIG. 5, the base assembly 12 includes the base 14, the vertical framing member 16, a top end 20, a resting seat 18, open windows 24, a horizontal connector member 26, and a top end 28 of the vertical framing members. One or more access openings 46 are formed in the sidewall of the base 14 as shown.

Figure 7:
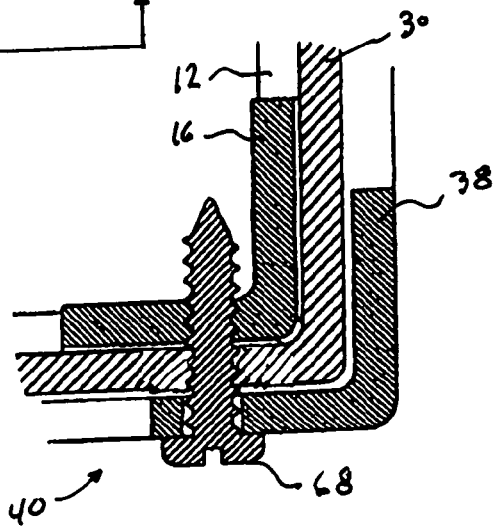
FIG. 7 is a detailed view of the fastening arrangement of FIG. 1.

With reference to FIG. 1, the fastening arrangement 40 typically consists of one or more fasteners 68 and an aperture 70 in a corner post 38 of the closed louver member 36, an aperture 72 in the light transmitting tube 30, and an aperture 74 in the vertical framing member 16. The open 32 and closed 36 louver members, the light transmitting tube 30, and the base 14 are all typically molded of plastic. Therefore, a threaded metal fastener 68, such as that shown in FIG. 7, is threaded through the corner post 38 of the closed louver member 36, the light transmitting tube 30, and the vertical framing member 16 to secure them with respect to the base assembly 12.

The light fixture 10 is typically provided with all of the separate pieces, such as the base assembly 12, light transmitting tube 30, and open 32 and closed 36 louver members assembled and secured together by the fastening arrangement 40. A blank cover 76, such as that shown in FIG. 1, is typically provided to close off the access openings 46 in the base 14 in the event an electrical device is not secured therein. To operate the invention, an installer would typically first remove the fasteners 68 and separate the pieces. A suitable support would be chosen, depending on whether the light fixture will be anchored to the ground or to a structural surface. Appropriate electrical cables are then routed into the support, thereby supplying either low or high voltage to the support. The base assembly 12 can then be secured to the support with an appropriate adhesive. A light source can then be mounted within the vertical framing members 16 of the light fixture 10 and wiring connections completed thereto. The installer can make wiring connections (not shown) within the light fixture by pulling the wiring through the access openings 46 and pushing them back through after connections are completed. If desired, wiring connections can be completed to one or more electrical devices, such as duplex receptacles, switches, or photocells, (not shown) after which the electrical device can be secured to the base 14 at the access opening 46. Referring to FIG. 1, the installation is completed by sliding the light transmitting tube 30 over the vertical framing member 16 until it rests on the resting seat 18, sliding a first open louver member 32 over the vertical framing member 16 until the corner posts 38 of the first open louver member 32 contacts the resting seat 18, sliding the remaining open louver members 32 over the light transmitting tube 30 until their associated corner posts 38 rest upon the open louver member previously installed, sliding the closed louver member 36 over the light transmitting tube 30, and then securing the louver members 32, 36 and light transmitting tube 30 to the base assembly 12 by driving the fasteners 68 through the apertures in the corner post 38, light transmitting tube 30, and closed louver member 36.

Referring to FIG. 1, the various pieces that comprise the light fixture 10 are typically molded of plastic. The integral rectangular base assembly 12, open louver members 32, closed louver member 36, blank cover 76, and light transmitting tube 30 are each typically molded in one piece from plastic. The preferred material of construction of the base assembly 12, open louver members 32, and closed louver member 36 is polyvinyl chloride, although other plastics would be acceptable. The preferred material of construction of the light transmitting tube 30, which will be transparent, is polycarbonate.

While the invention has been described by reference to the preferred embodiment disclosed herein, the invention is subject to considerable modification and may be tailored to fit the needs of many suitable mounting needs without departing from the scope or spirit of the claims which are appended hereto.

What is claimed is:

1. A light fixture comprising:

A. an integral rectangular base assembly including:

a base having a top end;

a plurality of vertical framing members extending from the four corners of said top end of said base and defining four open windows, said vertical framing members having a top end;

a resting seat at said top end of said base; and a horizontal connector member connecting said top end of said vertical framing members;

B. a light transmitting tube slidingly carried over said vertical framing members and said horizontal connector member;

C. one or more open louver members having central openings therein;

D. said open louver members slidingly carried over said light transmitting tube and supported by said resting seat;

E. a closed louver member slidingly carried over said light transmitting tube, said closed louver member substantially covering said light transmitting tube and said base assembly;

F. corner posts extending downwards from each of said louver members;

G. a fastening arrangement for securing said light transmitting tube and said louver members to said base assembly; and H. a first water dam at the intersection of said vertical framing member and said resting seat, said first water dam creating a weatherproof seal between said light transmitting tube and said base assembly when said light transmitting tube is secured thereto;

whereby said closed louver member and said open louver members form a vertically stacked layer of louver members surrounding said light transmitting tube with said corner posts maintaining open areas within said vertically stacked layer of louver members thereby allowing transmission of light from said light fixture through said windows, said light transmitting tube, and said open areas in said vertically stacked layer of louver members.

2. The light fixture of claim 1 wherein said closed louver member includes a lower surface and a peripheral lip.

3. The light fixture of claim 2 including a second water dam at the intersection of said lower surface and said peripheral lip of said closed louver member, said second water dam creating a weatherproof seal between said top end of said light transmitting tube and said closed louver member.

4. The light fixture of claim 1 wherein said light transmitting tube is of rectangular shape.

5. The light fixture of claim 2 wherein said light transmitting tube is molded of polycarbonate.

6. A light fixture comprising:

A. an integral rectangular base assembly including:

a base having a top end;

a plurality of vertical framing members extending from the four corners of said top end of said base and defining four open windows, said vertical framing members having a top end; and a horizontal connector member connecting said top end of said vertical framing members, B. a light transmitting tube surrounding said vertical framing members and said horizontal connector member;

C. one or more open louver members having central openings therein;

D. said open louver members surrounding said light transmitting tube;

E. a closed louver member on top of said open louver members and surrounding said light transmitting tube; and G. a fastening arrangement securing said light transmitting tube and said closed louver member to said base assembly in such a manner that said louver members are disposed in a fixed, unmovable relationship with respect to said light fixture.

* * * * *